US006464115B2

(12) United States Patent
Wemyss et al.

(10) Patent No.: US 6,464,115 B2
(45) Date of Patent: Oct. 15, 2002

(54) CAULKING GUIDE AND REINFORCING TIP

(76) Inventors: Jeff C. Wemyss, P.O. Box 574 41 Oxford Rd., Frankford ON (CA), K0K 2C0; Donald McColl, 85 Reagan Road R.R. #1, ON (CA), K0K 2C0

( * ) Notice: Subject to any disclaimer, the term of this patent is extended or adjusted under 35 U.S.C. 154(b) by 75 days.

(21) Appl. No.: 09/756,031

(22) Filed: Jan. 8, 2001

(65) Prior Publication Data

US 2001/0030207 A1 Oct. 18, 2001

Related U.S. Application Data

(60) Provisional application No. 60/179,141, filed on Jan. 31, 2000.

(51) Int. Cl.[7] ..... B65D 5/72

(52) U.S. Cl. ..... 222/567; 401/266; 425/87

(58) Field of Search ..... 222/527, 566, 222/567, 568, 570; 401/266; 425/87

(56) References Cited

U.S. PATENT DOCUMENTS

| | | | | | |
|---|---|---|---|---|---|
| 1,142,022 | A | * | 6/1915 | Chappell | 222/567 |
| 4,411,661 | A | * | 10/1983 | Kersten | 222/567 |
| 4,570,834 | A | * | 2/1986 | Ward | 222/567 |
| 5,010,618 | A | * | 4/1991 | Croft | 222/567 |
| 5,249,876 | A | * | 10/1993 | Hattman | 222/567 |

* cited by examiner

*Primary Examiner*—Philippe Derakshani
*Assistant Examiner*—Thach H. Bui

(57) ABSTRACT

A new, reusable caulking guide and reinforcing tip, removably attachable to the dispensing nozzle of a tube of caulking, glue or sealant, mounted upon a caulking or like gun, for assisting the efficient application of caulking compound to extended surfaces of different and varying widths from different and varying angles of attack, while also reinforcing and protecting the dispensing nozzle. The invention is preferably constructed of a flexible thermoplastic, such as polyethene.

23 Claims, 3 Drawing Sheets

SECTION I-I

CAULKING GUIDE AND REINFORCING TIP

This application claims benefit of Prov. No. 60/179,141 filed Jan. 31, 2000.

BACKGROUND OF THE INVENTION

1. Field of the Invention

The invention relates generally to caulking gun assemblies and attachments thereto, and their use in facilitating the application of caulk, sealant and glue (compound) to application surfaces, such as studs, joists and beams. More specifically, the invention provides a new, reusable caulking guide and reinforcing tip, removably attachable to the dispensing nozzle of a caulking gun assembly, for assisting the efficient application of compound to extended surfaces of different and varying widths from different and varying angles of attack, while also reinforcing and protecting the dispensing nozzle.

2. Description of the Prior Art

As used throughout this specification: the term "compound" means any caulking, glue, sealant or like compound or substance; the term "tube" or "tube of compound" means any tube, cartridge or like container in which compound is packaged; the term "gun" or "caulking gun" means any caulking gun or like device used to dispense compound from its tube; and the term "gun assembly" or "caulking gun assembly" means a caulking gun upon which a tube of compound has been mounted.

Compound is typically packaged within a long, cylindrical storage tube, constructed of either plastic or cardboard, and having a generally cylindrical dispensing nozzle at the front end of the tube and a circular back-end cap at the opposite end of the tube. The user mounts the tube upon a caulking gun, typically by fitting the tube into a long, semicircular holding receptacle on the gun. When the gun is "loaded", the back-end cap of the tube of compound is positioned against a back-end plate located at the back-end of the holding receptacle of the gun. The back-end plate of the gun is longitudinally translatable relative to the holding receptacle, and is activated by a trigger on the gun. When the trigger is kept depressed, the back-end plate of the caulking gun is forced forwards along the span of the holding receptacle and through the tube of compound. This also forces the back-end cap of the tube of compound forwards through the tube, thereby causing the packaged compound to be dispensed out through the dispensing nozzle. Compound continues to dispense for so long as the trigger is kept depressed.

Several difficulties arise in using these caulking gun assemblies.

A first significant difficulty relates to the several problems experienced in attempting to apply a straight and uniform bead of compound. It is very important that this be done well. Where compound is applied sloppily, the structural integrity of the project may be compromised, compound will be wasted, and the job will usually appear unsightly and require additional clean-up. Typically, the user of a caulking gun assembly commences a job by positioning the tip of the dispensing nozzle directly upon or slightly above the construction member to which the compound is to be applied. The challenge is then to keep the caulking gun trigger depressed, such that compound dispenses continuously and at a consistent rate, while simultaneously advancing the gun assembly along the length of the intended application surface at an appropriate relative angle and rate, this exercise being done "free-handedly". This can prove difficult even in the best of circumstances, owing to human limitations in co-ordination and stamina. As well, many common circumstances can compound the difficulties. Compound can prove difficult to apply to any narrow application surface, because the dispensing nozzle can easily slip off the surface. Compound can also be difficult to apply to a surface of considerable length, and/or to a surface which is awkwardly situated (overhead, etc.) or crowded. A job in these circumstances can require the user to undergo difficult and/or prolonged reaches and bodily contortions, and sometimes without having both hands free to operate the gun assembly. Job efficiency and personal comfort can suffer significantly. So can user safety, such as where the user must position himself over portions of a floor which have yet to be installed.

A second significant difficulty is that dispensing nozzles are easily damaged. A dispensing nozzle tends to bend, buckle or break when subjected to certain degrees of lateral pressure, commonly applied during normal free-handed use of the gun assembly. Where a dispensing nozzle is damaged, compound is wasted, and the job at hand may require additional clean-up and have to be redone.

The use of reusable caulking gun tips, spouts, nozzles and other attachments intended to facilitate various aspects of using caulking gun assemblies is known in the prior art.

U.S. Pat. No. 1,142,022, issued to Chappell, describes a nozzle device for applying mortar when pointing brick walls. The device includes a rigid, non-flexible trowel plate at the end of the nozzle designed to allow the application of mortar into an existing mortar joint between bricks and to smooth the material as it is being applied. The device does not act, and cannot act, as a guide to apply caulking or like material to an extended surface or construction member.

U.S. Pat. No. 4,101,077, issued to Gibson, describes a rounded tip spout. The nozzle of Gibson simply reconfigures the tip to provide a hemispherical end with material being discharged from the side of the hemisphere. The hemispherical shape is designed to smooth the bead of caulk as it is applied into a corner. U.S. Pat. No. 5,249,876, issued to Hattman, describes a triangular spear attachment. Like Gibson, the Hatman invention is intended to facilitate applying caulk into corner surfaces. The nozzle of Hattman may be provided with a flange at the base of the nozzle to assist in securing and removing the nozzle from the existing nozzle of the tube of compound. The flange on the Hattman nozzle does not provide substantial reinforcement between the joint of the existing nozzle and the front face plate of the tube of compound. The flange in the Hattman application is of a significantly smaller diameter than the front face plate of the tube of compound and consequently it has little or no reinforcing effect on the front face plate to arrest or prevent buckling of the face plate or the bending of the existing nozzle at the junction with the face plate.

U.S. Pat. No. 5,775,551 issued to Torsden, describes a nozzle attachment, having two planar side walls at right angles to one another. The device is intended to facilitate applying caulk to both sides of a right-angle corner, while also providing a guide to position the nozzle within the corner. Although this nozzle solves the problem of supplying filler material, simultaneously to each side of a right angled corner and provides a guide for assisting this, its geometry is not adaptable so as to allow it to be used to apply caulking material along an extended construction member.

U.S. Pat. No. 4,570,834 issued to Ward, describes an apparatus for extruding a fillet at the junction of two surfaces which form a right angled corner. Like Torsden, the Ward guide is designed to assist in the application of caulk to both sides of a right angled corner, however, additionally the guide includes a means for wiping the contacting surfaces so as to produce a neat and uniform fillet.

U.S. Pat. No. 5,010,618 issued to Croft describes a corner finishing tool for use in drywall finishing. The tool has wings spreading from a centre ridge that is configured to act as a collection reservoir and spreading mechanism for drywall compound in interior right-angled corners. The "wings" assist in positioning the tool in the interior corner and also directs excess drywall compound outwardly from the interior corner. The Croft invention is not designed or intended to be used in conjunction with a caulking gun. The device is intended to smooth material being applied but does not act as a guide to apply caulking or like material to an extended surface or construction member.

U.S. Pat. No. 5,249,716, issued to O'Sullivan, describes a nozzle attachment, which consists of a flexible extension tube attachment, and a shorter, angled and more rigid tube that fits over the flexible tube. U.S. Pat. No. 5,346,380, issued to Ables, relates to a bendable extension nozzle. Both devices are intended to extend and re-direct the reach of the dispensing nozzle. The Ables device also includes a "spoon" member, intended for smoothing the bead of caulk.

U.S. Pat. No. 4,411,661 issued to Kersten, describes a spike connector to permit the conveyance of fluid from a source through a "spike" nozzle. A pair of "wings" are located adjacent to the spike extending outwardly and away from the spike. The purpose of the wings is to provide a finger grip that is efficiently designed for easy insertion and removal of the spike connector. Although integral with the connector tip, the wings do not and cannot act as a guide to assist in the fluid application.

Although these patents relate to detachable and reusable caulking gun attachments, none describe the unique features and advantages of the present invention. None describe a caulking guide and reinforcing tip, removably attachable to the dispensing nozzle of a caulking gun assembly, for assisting the efficient application of compound to extended surfaces of different and varying widths from different and varying angles of attack, while also reinforcing and protecting the dispensing nozzle.

The prior art also discloses U.S. Pat. No. 4,932,565, issued to Paradiso, which describes a guide for attachment to a caulking gun, intended to enable a user to more easily and readily follow an object to which caulking compound is applied.

While the Paradiso guide may fulfill its particular objectives, the patent for same does not describe an invention like that herein claimed. Unlike the present invention, the Paradiso guide consists of an inverted "U"-shaped guide. Also unlike the present invention, the Paradiso guide is not substantially flexible. Also unlike the present invention, the Paradiso guide is intended to attach directly and permanently to the caulking gun by a bracket on the gun's underbody (rather than to the dispensing nozzle of a tube of compound). From these differences, it is apparent that the Paradiso guide cannot expand, or be readily cut or adapted to straddle different and varying widths of construction members. It is also apparent that the Paradiso guide would require the user to always keep the caulking gun assembly at a more or less constant angle of attack, while the gun assembly is advanced. Also unlike the present invention, the Paradiso guide does not in any way reinforce or protect the dispensing nozzle.

Given the aforesaid difficulties and limits to the prior art, it can be readily seen that there exists a need for a new, reusable and more versatile caulking gun attachment of the kind herein claimed.

BRIEF SUMMARY OF THE INVENTION

The invention overcomes the aforesaid difficulties.

The invention provides a new, reusable caulking guide and reinforcing tip, removably attachable to the dispensing nozzle of a caulking gun assembly. The invention comprises a flange and collar (the attachment and reinforcement means), and two guides. The flange consists of a flat, circular base, having therein a circular opening concentric with the flange. The opening is slightly larger than the diameter of the dispensing nozzle. The collar consists of an elongated cylinder of an exterior diameter slightly greater than the diameter of the circular opening in the flange, and being cylindrically hollow and open-ended at both ends, the hollow interior having a diameter approximately equal to the diameter of the circular opening in the flange. The collar is attached to the flange, concentrically and at a perpendicular thereto. The guides consist of two opposing planes, each being attached to and splaying outwardly from opposite sides of the top end of the collar, and in divergent relation to one another.

A principal object of the invention is to provide a caulking guide, for assisting in keeping the caulking gun assembly stabilized during free-handed usage, and in keeping the dispensing nozzle centered in place along an extended application surface, such that a straight and uniform bead of compound may be easily dispensed. The user attaches the invention to the caulking gun assembly, as below described. The gun assembly is then used generally as follows. The user positions the dispensing nozzle upon the intended application surface, applying such pressure as is required in order that the flexible guides be made to splay apart around the nozzle and straddle the two opposing sides of a construction member. When the gun assembly is then advanced along the application surface, the guides will travel in place alongside and gripping the two adjacent sides of the construction member, effectively providing the above stated advantages.

Another principal object of the invention is to provide a caulking guide, for assisting in preventing the dispensing nozzle from slipping off a narrow application surface, such as the edge of a stud, joist or pre-manufactured beam. The guides help prevent slippage by straddling the construction member to which compound is being applied, while the gun assembly is advanced along the length of the surface.

Another principal object of the invention is to provide a caulking guide, providing the aforesaid advantages, as may be used for different and varying widths of application surfaces. Because the guides are flexible, they can be made to conform, by the aforesaid simple procedure, to different construction members having widths varying within a considerable range. As well, the flexibility of the guides permits them to accommodate certain surfaces that vary in width from one end to another. As regards greater widths than the two guides can be made to straddle, the caulking gun assembly can be angled by the user, such that only one guide bears along one side of the construction member. Alternatively, one of the severable guides can be cut away with a knife to permit a similar usage.

Another principal object of the invention is to provide a caulking guide, providing the aforesaid advantages, as may be used with the caulking gun assembly being held by the user at different and varying angles of attack, while maintaining a straight and uniform bead of compound. Because the guides are both flexible and concentric with the dispensing nozzle, the gun assembly can be oriented at different angles, including from an acute or obtuse angle to the application surface, or from directly overhead. As well, the angle of attack can be substantially varied while the gun assembly is being advanced, while maintaining a straight and uniform bead of compound. This adaptive versatility can be particularly advantageous in difficult working circumstances, such as where compound must be applied across a surface of considerable length, and/or to a surface which is awkwardly situated (overhead, etc.) or crowded. The same or like advantage is not provided by guides which attach to the body of a caulking gun.

Another principal object of the invention is to provide a caulking guide, providing the aforesaid advantages, which assists comfortable and safe usage, not at the expense of efficiency.

Another principal object of the invention is to provide a reinforcement tip, which reinforces the dispensing nozzle of the tube of compound and helps prevent it from bending, buckling or breaking under normal, rigorous usage and between uses. The said collar is intended to physically surround, and thereby shield and reinforce with its added rigidity, the body of the dispensing nozzle. As well, the flange is intended to concentrically abut against the front face plate of the tube of compound, thereby reinforcing it as well. The front face plates of conventional tubes tend to be constructed of a thin metal, which, like dispensing nozzles, can buckle under normal usage.

Another object of the invention is to provide a caulking guide and reinforcement tip, providing the aforesaid advantages, which can be manually attached to and removed from the dispensing nozzle of a caulking gun assembly, quickly and without difficulty, and reused as required. The user attaches the invention to the dispensing nozzle by pushing the flange/collar over the dispensing nozzle until the flange is made to abut concentrically and flatly against the front face plate of the tube of compound, and the collar is fitted snugly around the dispensing nozzle. This may be done either before or after the tube of compound is mounted upon a caulking gun. In either case, the user then compresses together the flexible guides and fits and pushes them through the front-end orifice or slot (orifice) of the caulking gun until the flange abuts against the inside lip of the orifice. Once released, the guides naturally return to their original shapes, such that they splay outwardly from opposite sides of the orifice, in divergent relation to each other. The invention may be detached from the gun assembly by a substantially reverse procedure. The procedures are simple, and therefore can be completed quickly, as often as required.

Still another object of the invention is to provide a caulking guide and reinforcement tip, providing the aforesaid advantages, which is susceptible of a low cost of manufacture with regard to both materials and labor and can accordingly be made economically available to consumers.

These objects, together with other objects of the invention and the various features of novelty which characterize it, are identified with particularity in the claims included herewith. For a better understanding of the invention, its operating advantages and the specific objects attained by its uses, reference should be had to the accompanying drawings and description in which there is detailed a preferred embodiment.

It is emphasized that the purpose of this summary is to enable the U.S. Patent Office and the public generally, and especially the engineers and practitioners in the art who are not familiar with patent or legal terms or phraseology, to determine quickly, from a cursory inspection, the nature and essence of the technical disclosure, which is measured by the claims. The summary is not intended to be limiting of the scope of the invention in any way.

DETAILED DESCRIPTION

Figure 1:
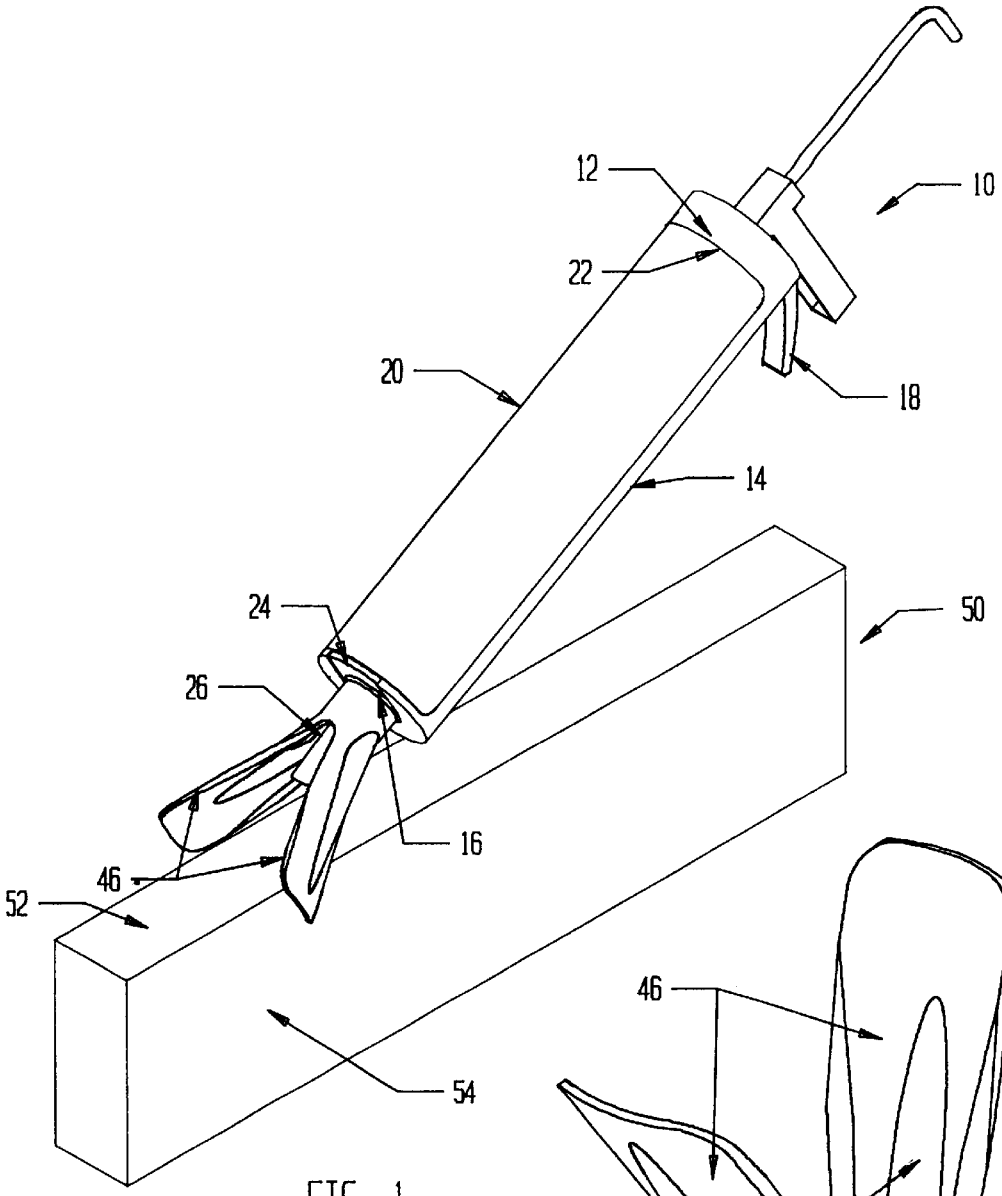
FIG. 1 is a reduced perspective view of the invention, showing it attached to a conventional caulking gun assembly, and in use in assisting the efficient application of compound along the edge of a member.
Figure 2:
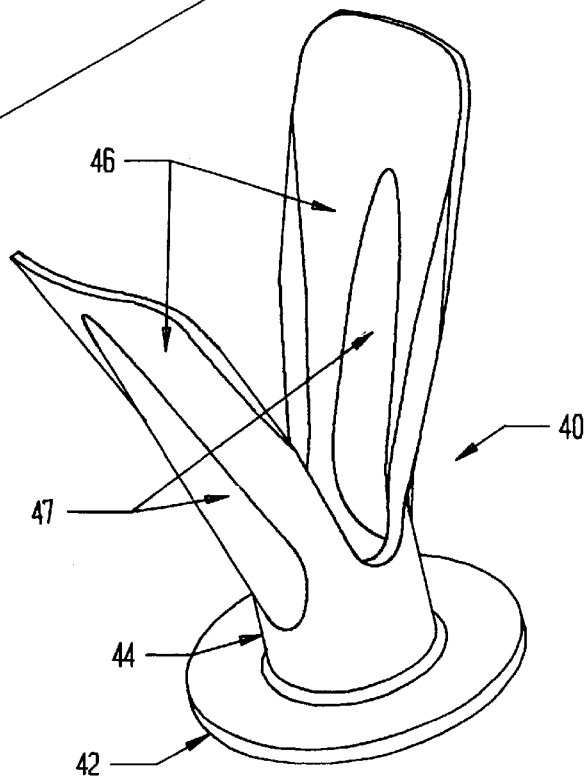
FIG. 2 is a perspective view of the invention.
Figure 3:
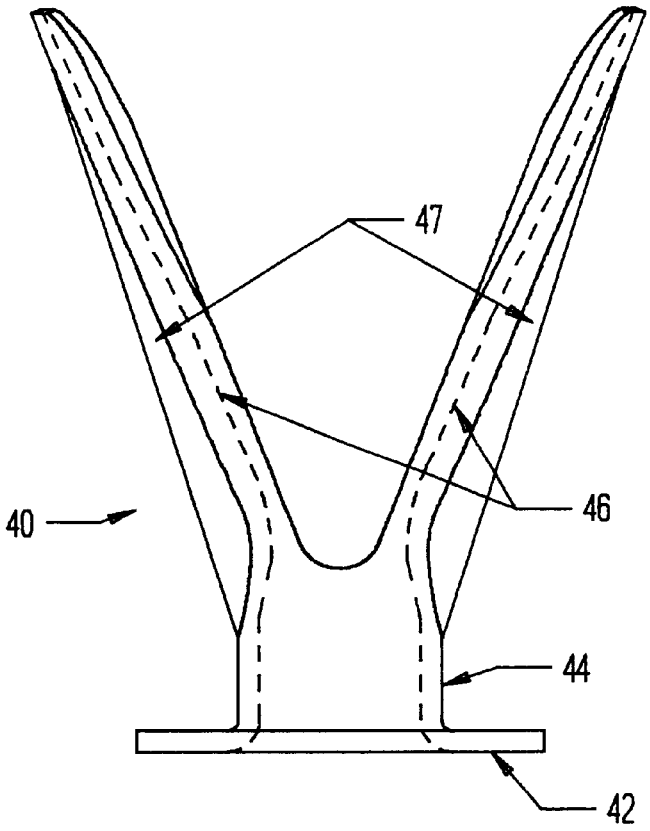
FIG. 3 is a top view of the invention.
Figure 4:
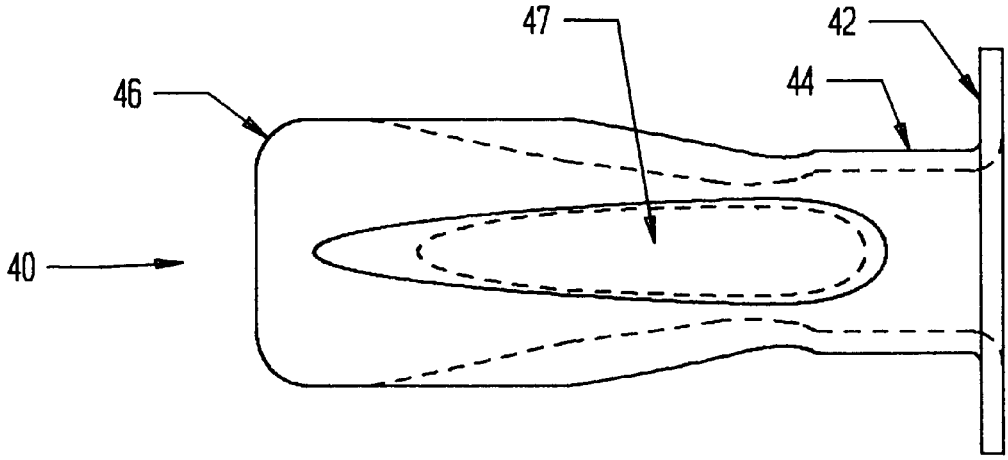
FIG. 4 is a side view of the invention.
Figure 5:
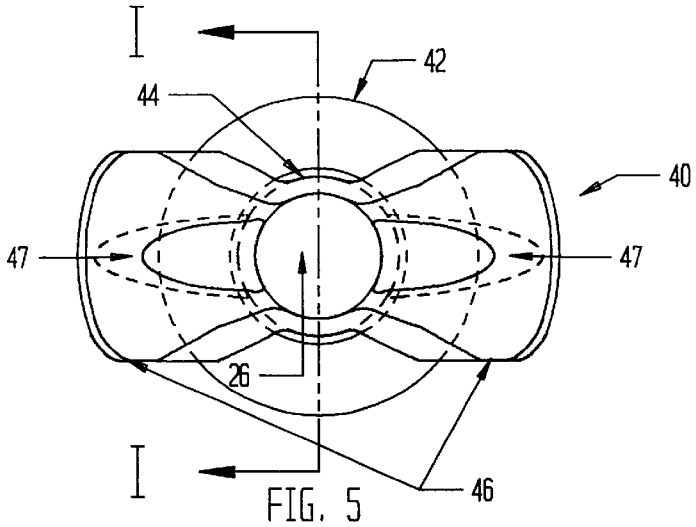
FIG. 5 is a front view of the invention.
Figure 6:
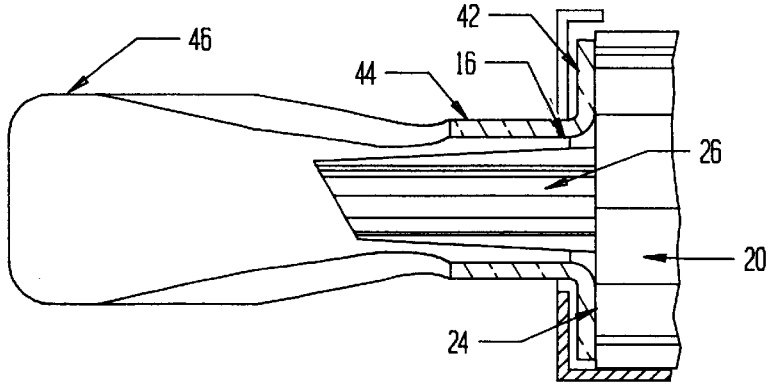
FIG. 6 is a cross sectional side view of the invention, showing it attached to the front section of a conventional caulking gun assembly.

A preferred embodiment of the inventive tip is now described with reference to the drawings, namely FIGS. 1 through 6 thereof.

A caulking gun assembly comprises a tube of compound 20, containing caulk, glue or sealant, mounted upon the holding receptacle 14 of the caulking gun 10. The conventional workings of the caulking gun assembly are as previously described.

The invention relates to a new, reusable caulking guide and reinforcing tip 40, removably attachable to the dispensing nozzle 26 of a caulking gun assembly. The invention comprises a flange 42 and collar 44 (collectively, the attachment and reinforcement means), and two reinforced guides 46. The flange 42 consists of a flat, circular base of a diameter approximately equal to the diameter of the front face plate 24 of the tube of compound, and having therein a circular opening concentric with the flange 42. The opening is slightly larger than the diameter of the dispensing nozzle 26. The collar 44 consists of an elongated cylinder of an exterior diameter slightly greater than the diameter of the circular opening in the flange 42, and being cylindrically hollow and open-ended at both ends, the hollow interior having a diameter approximately equal to the diameter of the circular opening in the flange 42. The collar 44 is integrally attached to the flange 42, concentrically and at a perpendicular thereto. The side walls of the flange 42 and collar 44 are slightly thicker than the walls of the guides 46. The guides 46 consist of two opposing planes, each being integrally attached to and splaying outwardly from opposite sides of the top end of the collar 44, and in divergent relation to one another. The guides 46 are generally trapezoidal in shape, are of a length at least twice that of the dispensing nozzle 26, each have a slight outwards curvature, and increase in surface width as they splay outwardly from the top end of the collar 44 at approximately 45 degrees to the axis of the collar 44. The guides 46 are each reinforced by a reinforcing rib 47 spanning the longitudinal axis of the guide 46. The invention 40 is preferably constructed of a flexible thermoplastic, such as polyethene.

The user attaches the invention 40 to the dispensing nozzle 26 of the caulking gun assembly by pushing the flange 42 and collar 44 over the dispensing nozzle 26 until the flange 42 is made to abut concentrically and flatly against the front face plate 24 of the tube of compound 20, and the collar 44 is fitted snugly around the dispensing nozzle 26. It is noted that the flange 42 and collar 44 are designed in varying dimensions, so as to permit snug attachment to most conventional tubes of compound 20. This may be done either before or after the tube 20 is mounted upon the caulking gun 10. In either case, the user then compresses together the flexible guides 46 overtop of the dispensing nozzle 26 and fits and pushes them through the orifice 16 of the gun 10 until the flange 42 abuts against the inside lip of the orifice 16. Once released, the guides 46 naturally return to their original shapes, such that they splay outwardly from opposite sides of the orifice 16, in divergent relation to each other. The invention 40 may be detached from the caulking gun assembly by a substantially reverse procedure.

A caulking gun assembly bearing the invention 40 is generally used as follows. The user positions the dispensing nozzle 26 upon the intended application surface, applying such pressure as is required in order that the flexible guides 46 be made to splay apart around the dispensing nozzle 26 and straddle the two opposing sides of a construction member 50. When the caulking gun assembly is then advanced along the application surface, whatever may be its width, from the most efficient, comfortable and safe angle(s) of attack, the guides 46 will travel in place alongside and gently gripping the two adjacent sides of the construction member 50, effectively providing the many aforesaid advantages. As regards greater widths than the two guides 46 can be made to straddle, the caulking gun assembly can be angled by the user, such that only one guide 46 bears along one side of the construction member 50. Alternatively, one of the severable guides 46 can be cut away with a knife to permit a similar usage. Also, because the guides 46 are both flexible and concentric with the dispensing nozzle 26, the caulking gun assembly can be oriented at different angles, including from an acute or obtuse angle to the application surface, or from directly overhead. As well, the angle of attack can be substantially varied while the caulking gun assembly is being advanced, while maintaining a straight and uniform bead of compound.

The flange 42 and collar 44 reinforces and protects the dispensing nozzle 26 and the front face plate 24 under normal, rigorous usage and between uses.

The embodiments of the inventive tip in which an exclusive property or privilege is claimed are defined as follows.

What is claimed is:

1. A new, reusable caulking guide and reinforcing tip, removably attachable to the dispensing nozzle of a tube of caulking, sealant or glue (compound), either before or after said tube of compound is mounted upon a caulking or like gun (caulking gun), for assisting the more efficient application of compound to extended surfaces of different and varying widths from different and varying angles of attack, while also reinforcing the dispensing nozzle and preventing it from bending, buckling or breaking, said invention comprising:

a dispensing nozzle attachment and reinforcement means, said device comprising:

a base comprising a flat, circular flange, of a diameter slightly less than the diameter of the face plate of a caulking tube, having therein a circular opening concentric with the flange which is of a diameter slightly greater than that of a dispensing nozzle of a tube of compound, and being substantially rigid, and said base being intended to abut concentrically against the front face plate of the tube of compound; and an elongated cylindrical collar of an exterior diameter slightly greater than the diameter of the circular opening in the flange, and being cylindrically hollow and open-ended at both ends, the hollow interior having a diameter approximately equal to the diameter of the circular opening in the flange, said collar also being substantially rigid, and attached to the flange, concentrically and at a perpendicular thereto, and said collar being intended to snugly fit around the body of the dispensing nozzle; and a caulking guide, said device comprising two opposing planes, each being attached to and splaying outwardly from the end of the collar, and in divergent relation to each other, and having such dimensions and flexibility that the application by the user of suitable force would permit their being compressed together and then fitted through the front-end orifice or slot of a caulking gun, and would also permit their being splayed substantially further apart at both or either sides of the collar and made to straddle or otherwise bear against innumerable different widths of construction members, such as studs, joists, beams and wider construction members, for use as versatile guides assisting the more efficient application of compound to extended surfaces from various and changing angles of attack, in each case without failing under prolonged usage, and being resilient, such that, when released from external forces, they naturally return to their original shapes.

2. The invention of claim 1 wherein the flange is integrally attached to the collar, and the collar is integrally attached to the caulking guide.

3. The invention of claim 1 wherein the invention is constructed of a thermoplastic.

4. The invention of claim 1 wherein the caulking guide is constructed of a material capable of being cut and severed away with a knife.

5. The invention of claim 1 wherein the flange has a diameter approximately equal to the diameter of the front face plate of a tube of compound.

6. The invention of claim 1 wherein each of the two caulking guide planes is generally trapezoidal in shape.

7. The invention of claim 1 wherein the two caulking guide planes increase in surface width as they splay outwardly from the lip of the top end of the collar.

8. The invention of claim 1 wherein each of the two caulking guide planes has a slight outwards curvature.

9. The invention of claim 1 wherein the two caulking guides splay outwardly from the lip of the top end of the collar, each at approximately 45 degrees to the axis of the collar, when not subjected to external forces.

10. The invention of claim 1 wherein each of the two caulking guide planes possesses a reinforcing rib to provide additional stiffness to the caulking guides.

11. The invention of claim 1 wherein the flange is held in place atop the front face plate of a tube of compound, such that the flange and attached collar and caulking guide can be made to turn either way about their common axis, further facilitating the more efficient application of compound to extended surfaces from various and changing angles of attack.

12. A new, reusable caulking guide, removably attachable to the dispensing nozzle of a tube of compound, either before or after said tube of compound is mounted upon a caulking gun, for assisting the more efficient application of compound to extended surfaces of different and varying widths from different and varying angles of attack, said invention comprising:

a collar, removably attachable to the dispensing nozzle of a tube of compound; and a caulking guide, said device comprising two opposing planes, each being attached to and splaying outwardly from the end of the collar, and in divergent relation to each other, and having such dimensions and flexibility that the application by the user of suitable force would permit their being compressed together and then fitted through the front-end orifice or slot of a caulking gun, and would also permit their being splayed substantially further apart at both or either sides of the collar and made to straddle or otherwise bear against innumerable different widths of construction members, such as studs, joists, beams and wider construction members, for use as versatile guides assisting the more efficient application of compound to extended surfaces from various and changing angles of attack, in each case without failing under prolonged usage, and being resilient, such that, when released from external forces, they naturally return to their original shapes.

13. The invention of claim 12 wherein the collar and caulking guide are integrally attached to one another.

14. The invention of claim 12 wherein the invention is constructed of a thermoplastic.

15. The invention of claim 12 wherein the caulking guide is constructed of a material capable of being cut and severed away with a knife.

16. The invention of claim 12 wherein each of the two caulking guide planes is generally trapezoidal in shape.

17. The invention of claim 12 wherein the two caulking guide planes increase in surface width as they splay outwardly from the lip of the top end of the collar.

18. The invention of claim 12 wherein each of the two caulking guide planes has a slight outwards curvature.

19. The invention of claim 12 wherein the two caulking guides splay outwardly from the collar, each at approximately 45 degrees to the axis of the collar, when not subjected to external forces.

20. The invention of claim 12 wherein each of the two caulking guide planes possesses a reinforcing rib to provide additional stiffness to the caulking guides.

21. A new, reusable reinforcing tip, removably attachable to the dispensing nozzle of a tube of compound, either before or after said tube of compound is mounted upon a caulking gun, for reinforcing the dispensing nozzle and preventing it from bending, buckling or breaking, said invention comprising:

a base comprising a flat, circular flange, of a diameter slightly less than the diameter of the face plate of a caulking tube, having therein a circular opening concentric with the flange, the opening being slightly larger than the diameter of a dispensing nozzle of a tube of compound, and being substantially rigid, and said base being intended to abut concentrically against the front face plate of the tube of compound; and an elongated cylindrical collar of an exterior diameter slightly greater than the diameter of the circular opening in the flange, and being cylindrically hollow and open-ended at both ends, the hollow interior having a diameter approximately equal to the diameter of the circular opening in the flange, said collar also being substantially rigid, and attached to the flange, concentrically and at a perpendicular thereto, and said collar being intended to snugly fit around the body of the dispensing nozzle.

22. The invention of claim 21 wherein the flange and collar are integrally attached to one another.

23. The invention of claim 21 wherein the invention is constructed of a thermoplastic.

* * * * *